United States Patent [19]

Hall

[11] Patent Number: 4,744,561

[45] Date of Patent: May 17, 1988

[54] SAFETY BASE WITH ANCHOR

[76] Inventor: Roger E. Hall, 100 Lakeview Dr., Elizabethtown, Pa. 17022

[21] Appl. No.: 647,534

[22] Filed: Sep. 5, 1984

Related U.S. Application Data

[60] Continuation-in-part of Ser. No. 472,241, Mar. 4, 1983, which is a continuation-in-part of Ser. No. 395,279, Jul. 6, 1982, Pat. No. 4,398,715, which is a continuation of Ser. No. 234,618, Feb. 17, 1981, abandoned, which is a division of Ser. No. 18,844, Mar. 8, 1979, Pat. No. 4,266,768, which is a continuation-in-part of Ser. No. 758,638, Jan. 12, 1977, abandoned.

[51] Int. Cl.[4] ..... A63B 71/00

[52] U.S. Cl. ..... 273/25

[58] Field of Search ..... 273/282 A, 25, 55 C; 24/662, 618, 447, 444, 449, 588, 589, 599, 621, 602, 607, 615, 652, 664, 204; 52/512

[56] References Cited

U.S. PATENT DOCUMENTS

| | | | |
|---|---|---|---|
| 1,971,545 | 8/1934 | Tompkins | 446/121 |
| 3,166,316 | 1/1965 | O'Leary | 273/26 E |
| 3,466,039 | 9/1969 | Golomb | 273/25 |
| 3,508,747 | 4/1970 | Orsatti | 273/25 |
| 3,572,705 | 3/1971 | Wybel | 273/25 |
| 3,579,745 | 5/1971 | Wilson | 273/55 C |
| 3,608,906 | 9/1971 | Older | 273/282 A |
| 3,703,285 | 11/1972 | Perry et al. | 273/25 |
| 3,862,756 | 1/1975 | Selliken | 273/25 |

*Primary Examiner*—Anton O. Oechsle
*Assistant Examiner*—Theatrice Brown
*Attorney, Agent, or Firm*—Kerkam, Stowell, Kondracki & Clarke

[57] ABSTRACT

A base and ground anchor system uses a resilient fastening arrangement to severably hold the base so as to minimize the likelihood of injury to a sliding base runner. The base uses a unibody exterior having fastener receiving holes disposed therein. Within the interior of the unibody resilient exterior is foamed material. A method of making the base uses rotational molding. By varying the cover thickness and/or foam density of the base, different severability characteristics are obtained. A method of using the base includes selecting the appropriate base dependent upon the cover thickness and/or foam density.

A tool includes a blade specifically adapted for cleaning dirt from the ground anchor.

12 Claims, 5 Drawing Sheets

FIG. 9.
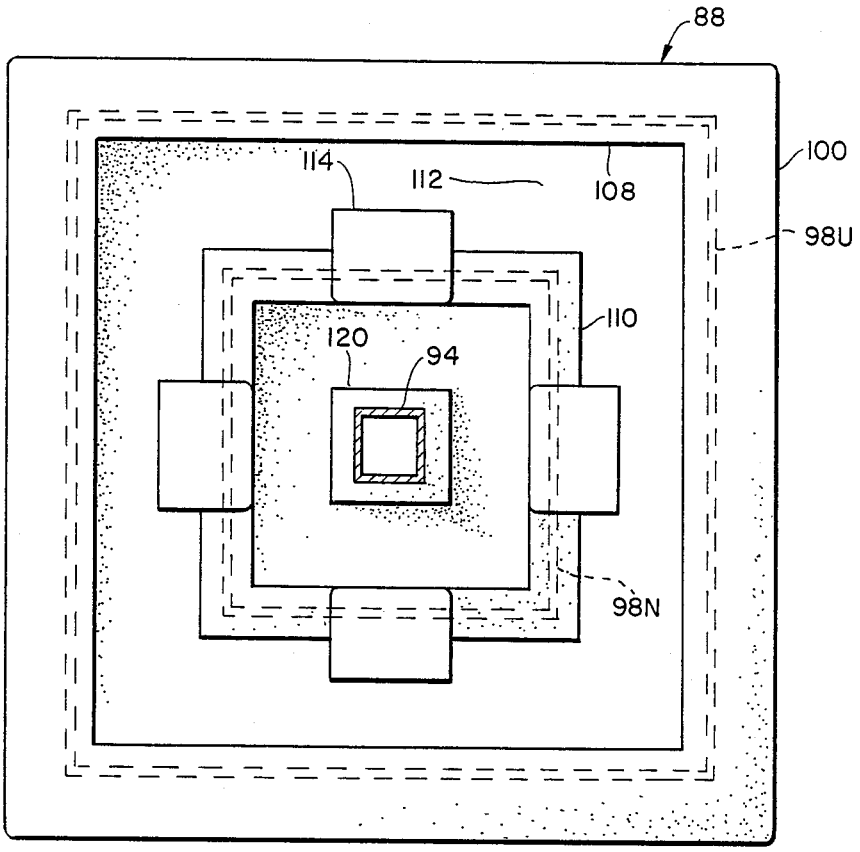
FIG. 12.
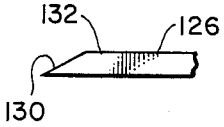
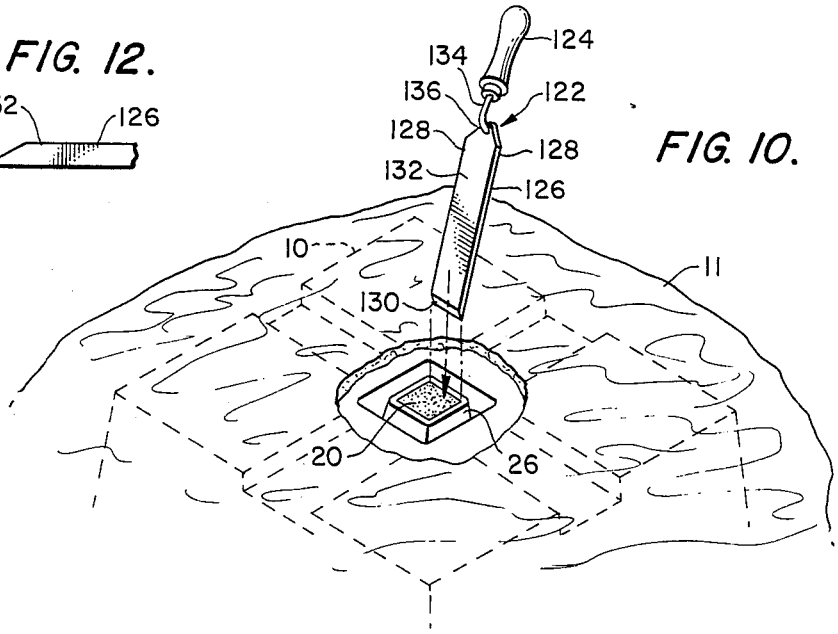
FIG. 10.

SAFETY BASE WITH ANCHOR

CROSS-REFERENCE TO RELATED APPLICATIONS

This application is a continuation-in-part of my copending application entitled "FASTENER AND SAFETY BASE USING SAID FASTENER" Ser. No. 472,241 filed Mar. 4, 1983. That application was in turn a continuation-in-part of Ser. No. 395,279 filed July 6, 1982, now U.S. Pat. No. 4,398,715 issued Aug. 16, 1983 which was a continuation of Ser. No. 234,618 filed Feb. 17, 1981 and now abandoned. Ser. No. 234,618 was a divisional application of Ser. No. 018,844 filed Mar. 8, 1979 now issued as U.S. Pat. No. 4,266,768 on May 12, 1981. Ser. No. 018,844 was in turn a continuation-in-part of Ser. No. 758,638 filed Jan. 12, 1977 and now abandoned. These applications and patents are hereby incorporated by reference.

BACKGROUND OF THE INVENTION

This invention relates to a base and a base anchor structure for playing baseball or similar sports. The invention further relates to methods of using and making such bases. Additionally, the invention relates to a tool specially adapted for use with such base supports.

Injuries are a widespread problem in the playing of sports. In particular, injuries often occur in baseball, softball, or similar sports wherein players slide into bases. If the base is fixed tightly into the ground, a player sliding into the base will often develop a leg injury. Even if the player sliding into the base does not develop a specific leg injury, the wear and tear of repeated slidings into a base may cause deterioration in the player's leg or legs over a long period of time. In addition, injuries occur to other parts of the body.

In order to minimize the likelihood of injury and/or long term damage caused by repeatedly placing great stress upon legs, numerous baseball bases have been designed to yield under lateral force. Some prior art bases have used springs to allow the base to move upon the application of force, whereas other bases have used magnets to allow the bases to move. Those prior art bases which use springs are disadvantageous in that the spring or springs will tend to deform after sufficient use. This may cause the displacement of the base from its proper position. Although stronger springs may minimize this problem, such stronger springs may prevent the base from yielding sufficiently to avoid injury to the sliding baseball runner. On the other hand, magnets may too easily allow the sliding of the base. Both the spring-biased bases as well as the magnetically secured based are disadvantageous in that metallic parts such as springs and magnets may rust and loose their efficiency with time. Further, dirt may collect next to the faces of the magnetic pieces and reduce their effectiveness.

Another problem with prior art bases is complexity of construction as, for example, the requirement of numerous time consuming steps in assembly of the bases and/or associated ground support structure.

Prior art anchoring systems for bases have often relied upon the placement of concrete within the ground. However, the concrete often cracks under adverse conditions such as exposure to water which freezes. Prior art ground anchor systems for bases have often been deficient in that they allow migration or movement of the anchor system. In other words, the ground anchor system moves within the dirt. Alternately, the dirt may be eroded from the side of the ground anchor system. In either case, the chances of injury are greatly increased in that a base runner may slide into the anchor system instead of the base. The base is usually covered by a canvas material and including a firm and resilient inner body sufficient to retain the shape of the base during play but somewhat yieldable in response to contact.

A problem common to numerous of the prior art yieldable bases is the difficulty in matching the yield or sever characteristics of the base with the class of player who will be using the base. A base which is designed to sever upon a hard slide by an 80 pound player will not be especially suitable for use by a 200 pound professional baseball player. Likewise, a base well suited for a professional baseball player would not yield sufficiently when used by a young baseball player. However, changing the bases to accommodate different classes of players has generally been difficult. Additionally, prior art anchoring systems and associated bases have heretofore been generally costly due to variations in the assembly procedure depending upon what type of base was being built. In other words, a base designed for a professional player may require different assembly steps than a base made for a young baseball player. Non-standard techniques of manufacturer and, sometimes the need for different anchoring systems depending upon the type of base, increase the cost.

Although numerous tools have heretofore been used for cleaning prior art bases, such tools have often been inadequate to conveniently clean a ground anchor system for proper operation.

OBJECTS AND SUMMARY OF THE INVENTION

Accordingly, it is a primary object of the present invention to provide a new and improved base and anchor support.

A further object of the present invention is to provide a new and improved method of using bases in accordance with the class of player.

A further object of the present invention is to provide a new and improved method of making bases.

A still further object of the present invention is to provide a new and improved tool for use in cleaning bases and/or their associated anchor systems.

A more specific object of the present invention is to provide a base, ground anchor system, and associated method such that the base may easily be fastened to the ground anchor system so as to sever under a sufficiently high force relative to the class of baseball player using the base.

Yet another object of the present invention is to provide a ground anchor system which is resistant to movement and damage.

A further object of the present invention is to provide a base, anchor system, and method of making the base which are relatively simple to assemble by the ultimate user, low in cost, and easy to manufacture.

A still further object of the present invention is to provide a tool which is specifically adapted for cleaning the ground anchor system of the present invention.

The above and other objects of the present invention which will become apparent as the description proceeds are realized by an athletic contact device comprising a base having a resilient and a foam interior, the exterior including a lower mounting surface having a generally horizontal portion, the generally horizontal portion including a plurality of recesses, each recess having an engagement portion disposed at its entrance and defining a hole which is narrower than at least part of the recess, and wherein the recesses and engagement portions are operable to severably fasten the base to a lower ground support having upwardly extending resilient fasteners which extend into the recesses such that one or more of the engagement portions is severable from the corresponding fastener or fasteners upon a sufficiently high lateral force. The exterior includes a single integral piece comprising the lower mounting surface and a cover portion, the recesses being within the integral piece. The lower mounting surface further comprises beveled edges extending out and downwardly. Each of the engagement portions is a lip defining a circular hole. The device further comprises a lower ground support having a plurality of upwardly extending resilient fasteners engageable to the engagement portions. The lower ground support comprises a rigid support member with a plurality of resilient fasteners fixed thereto. The plurality of resilient fasteners are integral with each other and are integrally part of a resilient encasing portion extending above and below the support member at least at its periphery. The support member is a support plate, and the lower ground support further comprises: a support tube fixed to extend downwardly from the support plate; a ground anchor housing having a receiving tube disposed therein, the receiving tube receiving the support tube to removably hold the support plate relative to the ground anchor housing. The ground anchor housing is wider at its bottom than at its top and includes side walls having at least one peripheral outwardly extending ground holding portion operable to resist removal of the ground anchor housing from the ground. The ground anchor housing is adapted for filling with concrete or other type of cement (i.e., soft substance that hardens like stone upon drying) and includes concrete holding means for holding the ground anchor housing to concrete. The concrete holding means comprises a plurality of upwardly extending ribs on a top surface of the ground anchor housing, the ribs defining a plurality of dirt receiving recesses. The encasing portion has a plurality of locator means on its bottom and is operable to mate with a plurality of complimentary locator means on the top of the ground anchor housing, the locator means and complimentary locator means together minimizing any pivoting of the rigid support member relative to the ground anchor housing.

The present invention may alternately be described as an athletic contact device comprising a base having: a resilient unibody exterior including an upper cover and a lower mounting surface having a generally horizontal portion, a plurality of resilient fastening means integral with the unibody exterior and disposed on the generally horizontal portion, the fastening means operable to hold the base to a lower ground support; and a foam interior. The device further comprises a lower ground support having a plurality of mating fastening means to fasten to the fastening means on the base.

The present invention may alternately be described as an athletic contact device comprising: a lower ground support having a rigid support member and a plurality of resilient fastening means, the fastening means operable to mate with fastening means on a base placed above the lower ground support; a resilient encasing portion disposed above and below the support member at least at its periphery; and wherein the lower ground support further comprises: a support tube fixed to extend downwardly from the support member; a ground anchor housing having a receiving tube disposed therein, the receiving tube receiving the support tube to removably hold the support member relative to the ground anchor housing. The ground anchor housing is wider at its bottom than at its top and includes side walls having at least one peripheral outwardly extending ground holding portion operable to resist removal of the ground anchor housing from the ground. The ground anchor housing is adapted for filling with concrete or other type of cement and includes concrete holding means for holding the ground anchor housing to concrete. The ground anchor housing is rigid plastic.

The invention may alternately be described as an athletic contact device comprising: a lower ground support having a rigid support member and a plurality of resilient fastening means, the fastening means operable to mate with fastening means on a base placed above the lower ground support; a ground anchor housing having a receiving hole disposed therein, the receiving hole receiving a support tube extending downwardly from the support member to removably hold the support member relative to the ground anchor housing, the ground anchor housing operable to serve as a mold for concrete or other type of cement placed within the ground anchor housing prior to disposing the ground anchor housing within the ground. The ground anchor housing further comprising concrete (or cement) holding means for holding the ground anchor housing to concrete and wherein the concrete holding means comprises a plurality of upwardly extending ribs on a top surface of the ground anchor housing, the ribs defining a plurality of dirt receiving recesses.

The present invention may alternately be described as an athletic contact system comprising: a lower ground support as discussed above; and a plurality of bases selectively and severably attachable to the lower ground support by way of the fastening means, each base having a resilient exterior and a foam interior, and wherein the bases sever from the ground support at different lateral forces due to differences in characteristics of the bases, the characteristics selected from the group of: variations in exterior thickness, and/or variations of the foam density.

The method of adapting an athletic contact device to various classes of players according to the present invention comprises the steps, not necessarily in order of: disposing a ground anchor at least partially within the ground; removably securing a rigid support member to the ground anchor, the rigid support member having a plurality of resilient lower fastening means attached thereto; selecting a base having a resilient exterior and a foam interior and a plurality of resilient upper fastening means operable to mate with the lower fastening means, the base being selected dependent on the thickness of its exterior and/or the density of its foam to realize a desired severability level corresponding to the class of players which are to use the base, the lower fastening means accommodating bases of different severability levels corresponding to differences in their exterior thicknesses and/or foam densities; and removably securing the selected base to the rigid support member by way of the upper and lower fastening means.

The method of making the base according to the present invention comprises the steps of: placing moldable material within a rotational mold; rotating the mold with the application of heat to form a resilient base exterior; disposing foaming material within the exterior; and foaming the foaming material within the exterior.

The tool especially adapted for removing dirt from a ground anchor receiving tube of a base according to the present invention comprises: a handle, a blade attached to the handle, the blade having a width of at least 1 inch and extending lengthwise along two parallel side edges at least 5 inches to an end edge opposite the handle and perpendicular to the side edges, the blade width being within ⅛ inch of the width of the receiving tube.

BRIEF DESCRIPTION OF THE DRAWINGS

The above and other features of the present invention will be more readily understood when the following detailed description is considered in conjunction with the accompanying drawings wherein like characters represent like parts throughout the several view and in which:

FIG. 9 shows a view taken along lines 9—9 of FIG. 4 and illustrating the underside of a ground support plate assembly used with the present invention.

FIG. 10 shows a perspective view of the ground anchor and a tool used for cleaning the ground anchor.

FIG. 12 shows a detail side view of a part of the tool.

DETAILED DESCRIPTION

Figure 1:
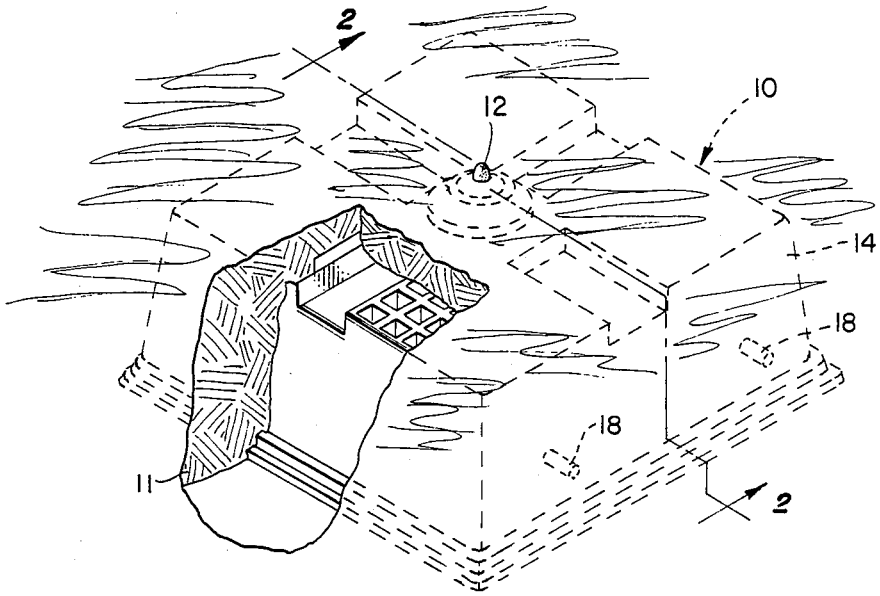
FIG. 1 shows a perspective view of a ground anchor system according to the present invention and with a locator plug disposed therein.
Figure 2:
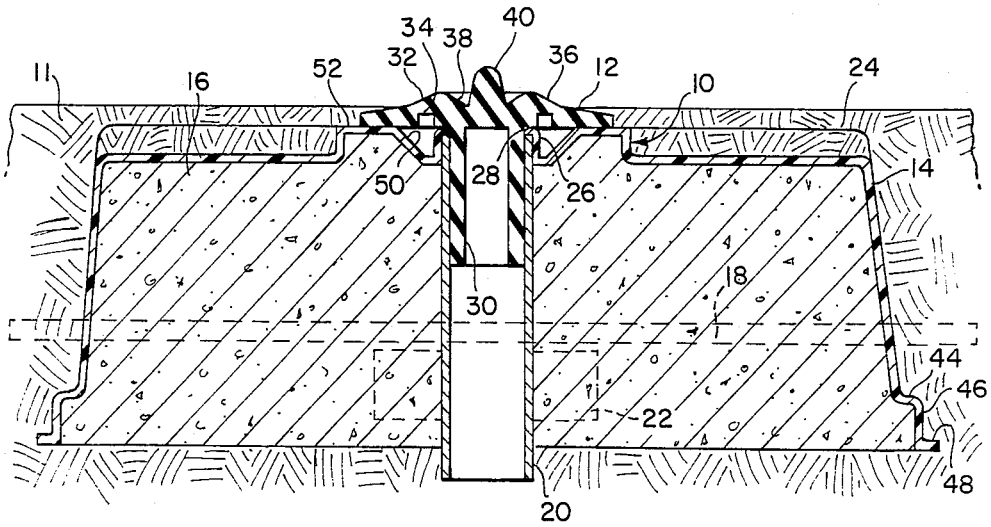
FIG. 2 shows a cross-section view along lines 2—2 of FIG. 1.

Turning now to FIGS. 1 and 2, a ground anchor system 10 and associated locator plug 12 according to the present invention will be described in detail. Both FIGS. 1 and 2 show the ground anchor system disposed within the ground with the locator plug 12 extending above the ground. FIG. 1 is a perspective view with parts of the dirt removed for illustrative purposes, whereas FIG. 2 is a cross-section view along lines 2—2 of FIG. 1.

The ground anchor system 10 comprises a ground anchor housing 14, preferably made of hard plastic material (to shed water) and having a square cross-section taken in a horizontal plane (thereby maximizing resistance to pivoting of the anchor system 10 within the ground).

The ground anchor system 10 further includes a block of concrete (or other type of cement) 16 disposed within the housing 14, two wooden dowels 18 extending through holes on opposite sides of housing 14 and set in the concrete 16, and a square cross-section receiving tube 20 having a reinforcing bar 22 also set within the concrete 16. The receiving tube 20 extends upwardly to the top 24 of the housing 14 and is received within a upwardly extending square cross-section portion 26 which has an inwardly extending lip 28 at its top to prevent the receiving tube 20 from moving above the top 24. The locator plug 12, preferably made of rubber, is shown placed within the top of the receiving tube 20. The locator plug 12 helps to locate the ground anchor system 10 although anchor 10 is buried within the ground. Additionally, the rubber of the locator plug 12 minimizes the likelihood of injury caused by persons falling upon the ground adjacent the buried metallic receiving tube 20. Further, the locator plug 12 serves to shed water away from the metallic receiving tube 20.

With particular reference to FIG. 2, the locator plug 12 has a square shaft portion 30 extending up to a head portion 32 having four channels 34, each of which parallels one of the sides of shaft portion 30. Shaft portion 30 is hollow with a cylindrical hole. The top of the head portion 32 has 360 degrees of symmetry and includes upwardly tapered surface portions 36, annular recess 38 and locator pin 40. The taper on surface portions 36 is such that a rack or similar tool used to smooth off a ball field will overshoot or just barely tip the top of the locator pin 40, thereby avoiding the dislocation of the locator plug 12.

Figure 8:
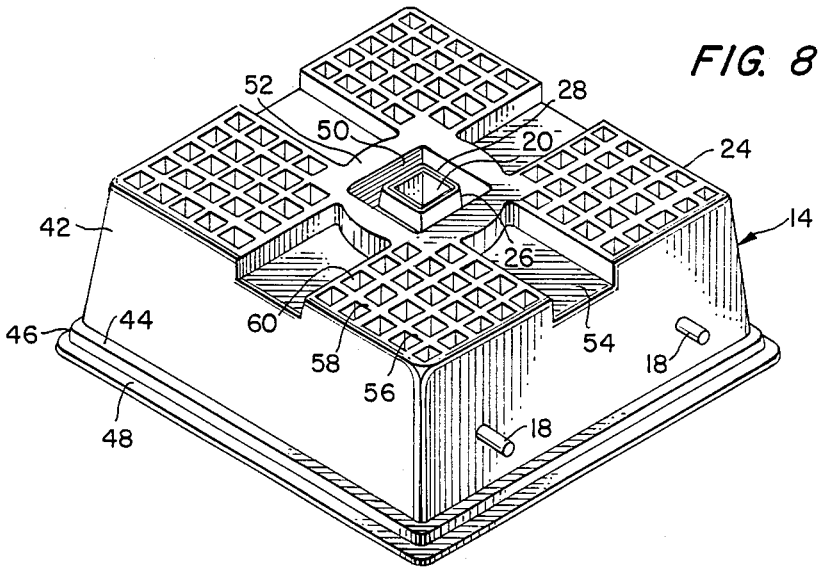
FIG. 8 shows a perspective view of the ground anchor housing of the present invention.

Continuing to view FIGS. 1 and 2, but also considering the perspective view of FIG. 8, the specifics of the ground anchor housing 14 will be discussed. In particular, the top 24 of housing 14 is preferably fifteen inches square, whereas the sides 42 are tapered outwardly to a horizontally extending surface 44, vertically extending surface 46 and horizontally extending bottom portion 48. (As used herein, "horizontal" and "vertical", "top", and "bottom" are with reference to directions defined upon the anchor housing 14.) The outward tapering of the sides 42 and especially the peripheral outwardly extending ground holding portions 44 and 48 serve to stabilize the ground anchor housing 42 within the ground as best appreciated from the view of FIG. 2. For the illustrated embodiment, the housing 14 is fifteen inches square at its top and eighteen inches square at the bottom ground holding or horizontal portion 48.

The top 24 of the housing 14 has a central hole defined by the portion 26 and within enclosing lips 28, the receiving tube 20 being disposed therein. Just outside of the tubular portion 26 is a recessed portion 50 surrounded by an upper surface 52 having the same horizontal level as the upper end of portion 26. Disposed outside of the upper surface portion 52 are four orthogonal channels 54, which preferably may slant slightly downwardly towards the sides 42 so as to repell or drain water away from the center and the metallic receiving tube 20. At each of the four corners of the top 24 are waffle portions 56, each of which includes a plurality of upwardly extending ribs 58 (having their tops level with upper surface 52) with dirt receiving recesses 60 disposed between the ribs 58. The top 24 of housing 14 is hollow within the ribs 58 such that the concrete 16 (FIG. 2 only) will extend into the ribs 58 and serve as a concrete holding means for increasing the surface area between the concrete and the top 24.

The assembly of the ground anchor system 10 is relatively straightforward. The housing 14 is turned upside down and the receiving tube 20 is slid into the tubular portion 26. The dowels 18 are placed within the housing 14. Although FIG. 2 shows the reinforcing bar 22 as being parallel to the dowels 18, it could alternately be perpendicular to the dowels 18. Concrete is placed within the housing 14 and extends to within the concrete holding ribs 58. After the concrete has sufficiently hardened, the ground anchor system 10 including the housing 14, concrete 16 and associated parts are placed into the ground 11 such that the top 24 is slightly below the ground level as shown in FIG. 2. Dirt will extend substantially over the top 24 except that locator plug 12 protrudes slightly from the dirt and minimizes dirt going into the receiving tube 20.

Figure 3:
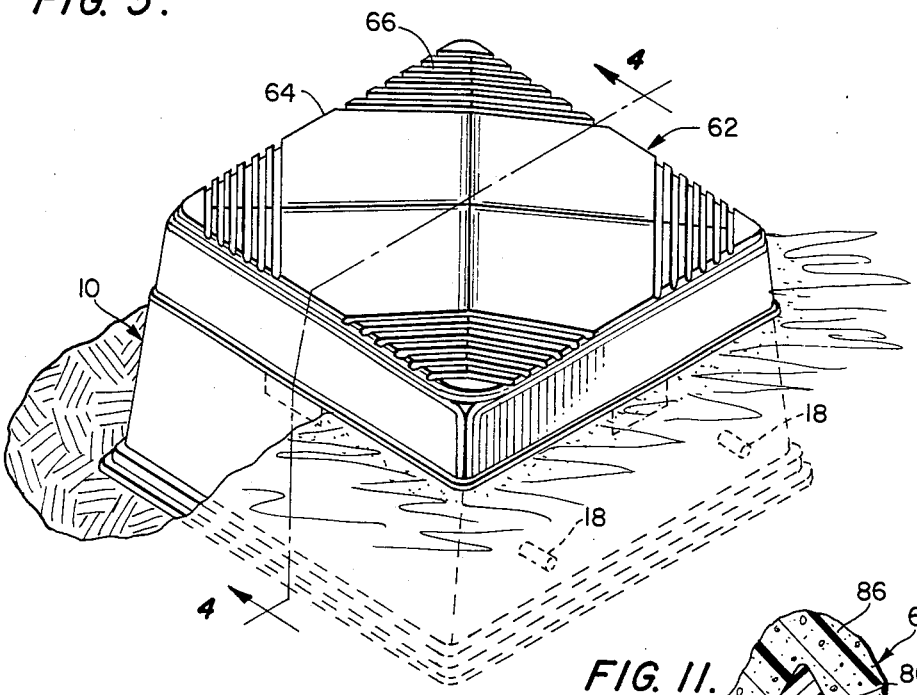
FIG. 3 shows a perspective view of the ground support system with a base attached thereto.
Figure 4:
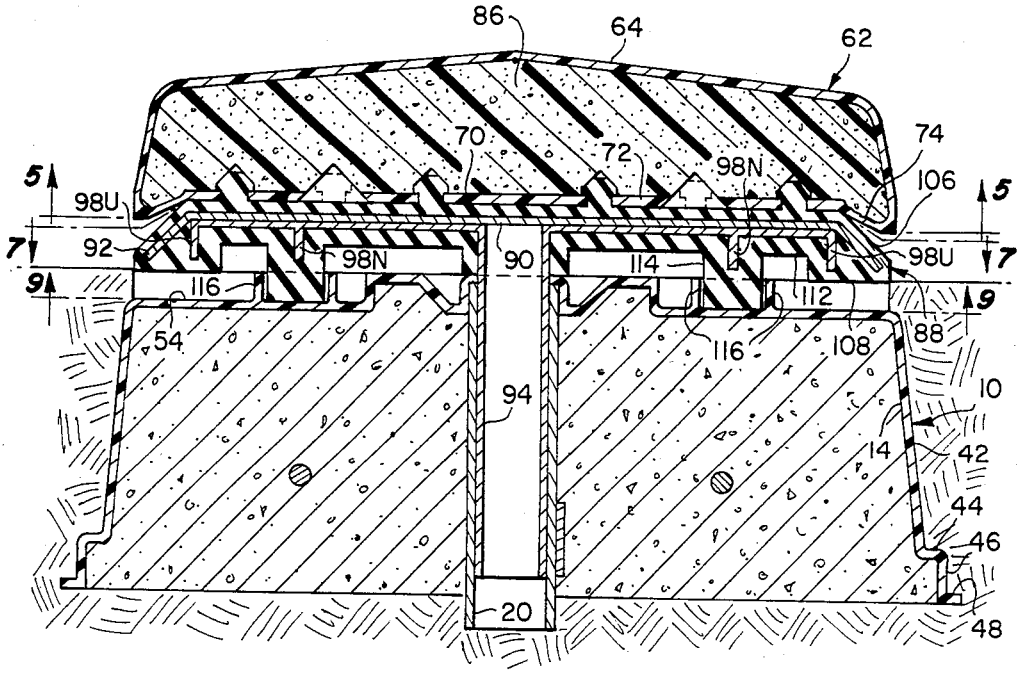
FIG. 4 shows a cross-section view taken along lines 4—4 of FIG. 3.
Figure 5:
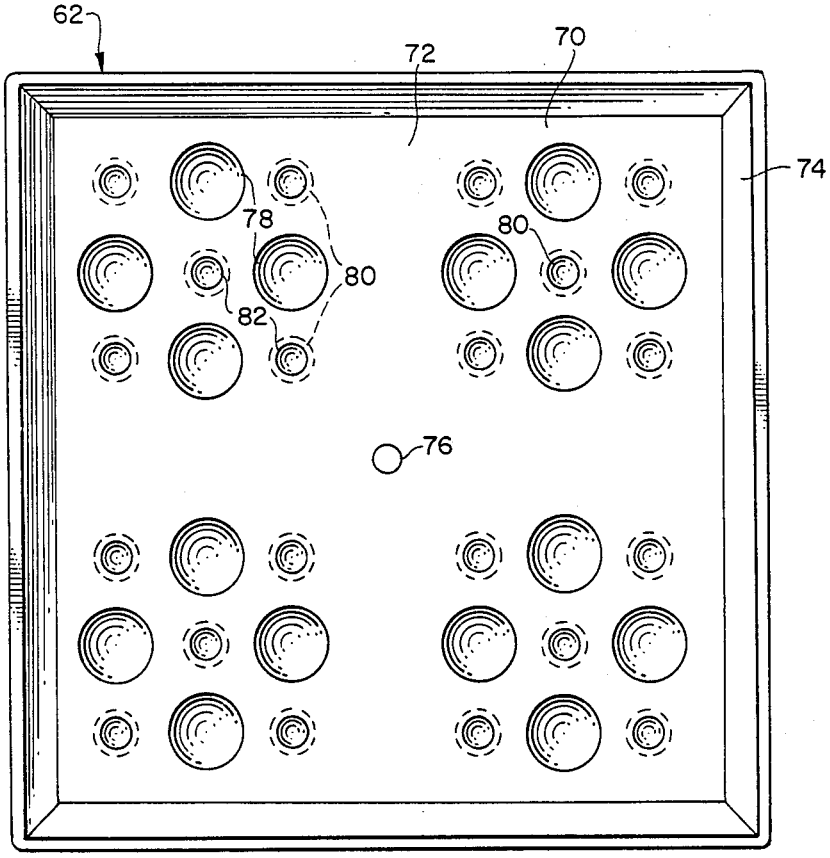
FIG. 5 shows a view taken along lines 5—5 of FIG. 4 illustrating the underside of the present base.
Figure 6:
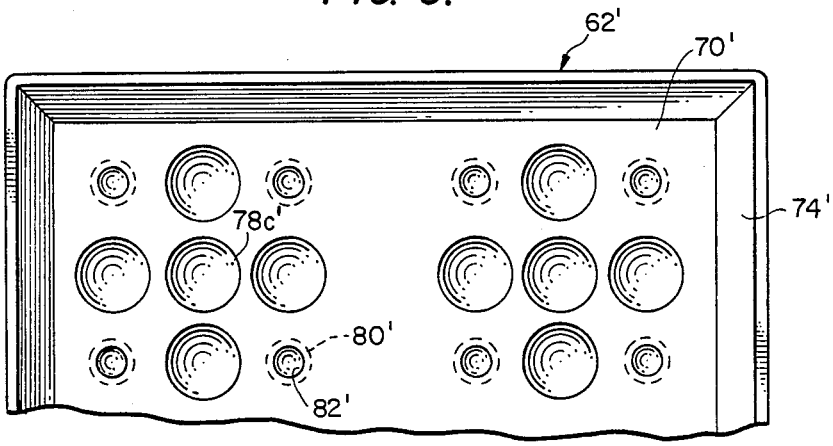
FIG. 6 shows an underside view of an alternate base with portions broken away.

Turning now to FIGS. 3, 4, 5, and 6, the base 62 of the present invention will be discussed in detail. FIG. 3 shows a perspective view of the base 62 mounted upon the ground anchor system 10, whereas FIG. 4 shows a cross-section view taken along lines 4—4 of FIG. 3. FIG. 5 shows a view of the underside of the base 62 as taken along lines 5—5 of FIG. 4. FIG. 6 shows a bottom view of an alternate base 62'.

The base 62 includes an exterior 64 having a number of grooves or flutes 66 in the top portion or upper cover 68. The grooves 66 are very helpful in maintaining traction and provide a visual indication of where the runner should step. The grooves, which are disposed at the corners at a 45° angle to the sides of the base, also provide a visual indication to the runner that the base is a severable base. The grooves comprise alternate ridges and recesses in the exterior of the base. The unibody exterior 64 further includes a lower mounting surface portion 70 having a generally horizontal portion 72 with beveled edges 74 extending out and downwardly. A filler plug 76 may be adhered or otherwise fixed to the center of the horizontal portion 72 in order to plug a hole in the exterior 64. The plug 76 (shown in FIG. 5 only) may alternately be plastic welded into the center of the horizontal portion 72 and serves to plug a hole (not shown) used in forming the base 62.

As best shown in FIG. 5, the underside horizontal portion 72 includes a number of conical depressions 78 intermixed in an array with recesses 80.

Figure 11:
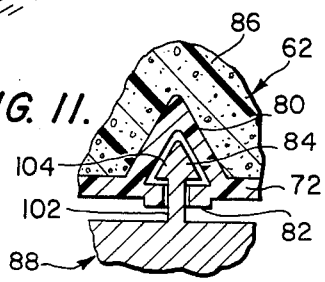
FIG. 11 shows a side cross-section detail illustrating how the base is severably attached to its support.

The details of construction of the recesses 80 are shown in the detailed cross-section view of FIG. 11. In particular, each of the recesses 80 is integral with the horizontal portion 72 and the unibody exterior 64 and includes an engaging portion lip 82 which is circular and defines a hole narrower than the base of the recess 80. Accordingly, the recess 80 and associated engaging lip serve as a resilient fastening means operable to severably fasten to a lower resilient fastening means 84 as discussed in detail below.

Disposed within the exterior 64 is a resilient, cellular foam material 86. As will be discussed in detail below, the base 62 has different characteristics depending upon the density of the foam 88 within the exterior 64 and the thickness of the resilient exterior 64. Additionally, the characteristics of the base may be dependent upon the number of recesses 80 disposed within the horizontal portion 72 of the base. For example, as shown in the alternate embodiment of FIG. 6, the base 62' is constructed substantially identical to base 62 except that an extra conical recess 70C' is used at the center of each of the three by three arrays defined by depressions 78 and recesses 80. In other words, the FIG. 6 embodiment has an extra conical depression 78C' in place of the center recess as used with the FIG. 5 embodiment. Basically then, the FIG. 6 embodiment has fewer of the upper fastening means realized by the recesses 80' and engagable lip portions 82' than the FIG. 5 embodiment. By varying the number of recesses 80 on the base 62, one may vary the severability characteristics of the base.

Figure 7:
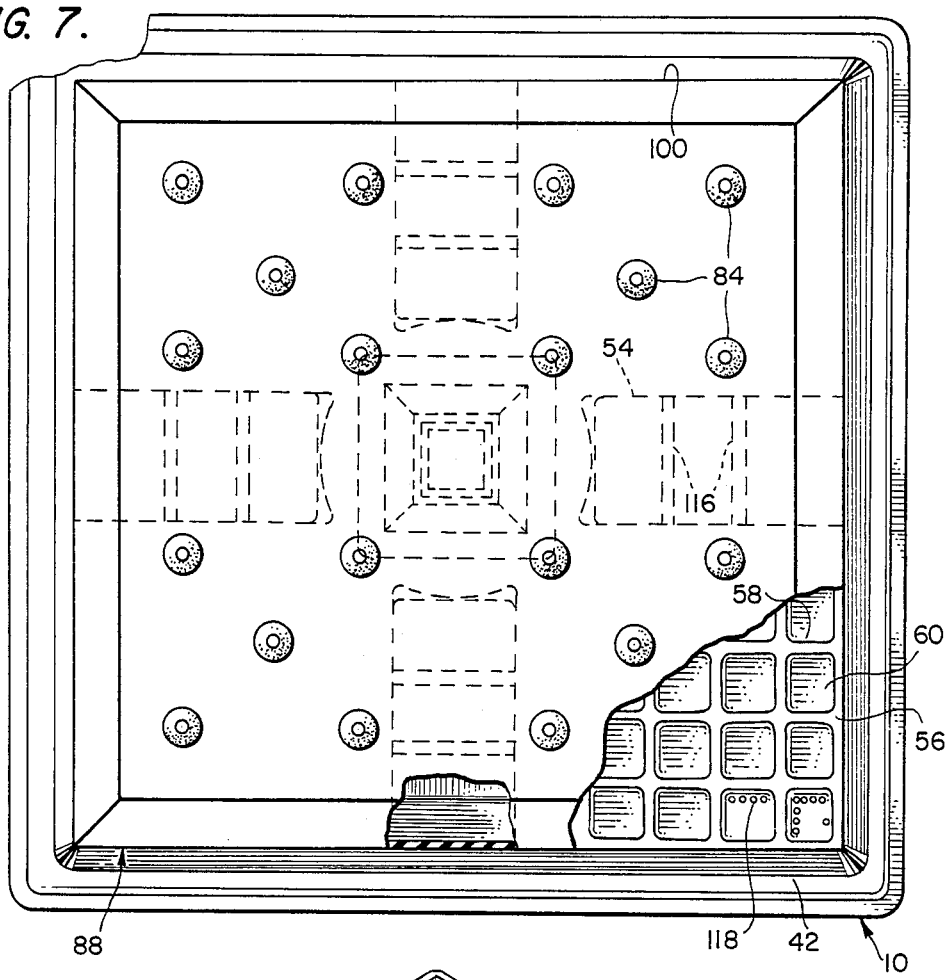
FIG. 7 shows a view taken along lines 7—7 of FIG. 4 and with parts broken away.

Concentrating now on FIGS. 4, 7, and 9 an intermediate support structure 88 will be discussed in detail. FIG. 7 shows a top view of the intermediate structure 88 as mounted upon the ground anchor housing 14 with parts broken away and corresponds to lines 7—7 of FIG. 4. FIG. 9 shows a bottom view of the intermediate member 88 as seen from lines 9—9 of FIG. 4.

As best shown in FIG. 4, the intermediate structure 88 is disposed intermediate the ground anchor system 10 and the base 62. Intermediate structure 88 and anchor 10 together constitute a lower ground support for base 62. The intermediate structure 88 comprises a rigid, preferably metallic, upper support member or plate 90 which is generally flat except for downwardly projecting edges 92. The edges 92 extend around the square periphery of the plate 90. A support tube 94 is bolted (bolts not shown) or otherwise fixed to the support member 90 to extend downwardly therefrom. The support tube 94 preferably has a square cross-section to match and fit within the square cross-section of the receiving tube 20 of the ground anchor system 10. (The interior of tube 20 may be considered to be a receiving hole.) Attached on the underside of the upper support plate 90 is a double ribbed member 96 having square inner and outer ribs 98N and 98U respectively. Although the ribbed member 96 is shown as extending inwardly to the support tube 94, it could alternately be a picture-frame type of structure with ribs 98U and 98N defining its edges.

Surrounding the support member or plate 90 is a resilient encasing portion 100 (preferably rubber) with a plurality of upwardly extending resilient fasteners 84 (see also FIG. 11), each of which includes a shaft portion 102 and a head portion 104. As shown in FIG. 11, the generally conical head 104 serves to resiliently and severably hold the intermediate member 88. At the edges of the top encasing portion 100 are downwardly beveled portions 106 extending in a square around the square edges of portion 100.

As best shown on the bottom view of FIG. 9, the underside of the encasing portion 100 includes an outer ridge portion 108 separated from an inner ridge portion 110 by a depression 112. Mounted at four locations along the inner ridge 110 are four locator blocks 114 which extend below the level of outer ridge 108 (see FIG. 4) which is at the same level as most of the inner ridge 110. The blocks 114 have a length (long dimension in FIG. 9) corresponding to the width of the channels 54 such that the locator blocks 114 fit in corresponding ones of the channels 54 with the ribs 56 at the edge of channels 54 capturing the blocks 114. This minimizes any tendency of the intermediate structure 88 to rotate relative to the ground anchor system 10. Additionally, as shown in FIGS. 4 and 7, cross channels ribs 116 may be used in each of the channels 54 to further capture the locator blocks 114. The cross channel ribs 116 could include a narrow slit at their bottoms and along the floor of channels 54 to allow water drainage if desired. Alternately, the cross channel ribs 116 could simply be solid as shown in FIG. 4.

In addition to use of the locator blocks 114 as locator means to locate the intermediate membr 88 with respect to corresponding locator means (channels 54 and cross-channel ribs 116) in the ground anchor housing 14, a plurality of cleats 118 (shown in FIG. 7 only) are disposed upon the bottom of the encasing portion 100. The cleats 118, only some of which are shown in FIG. 7, are used to further lock the intermediate member or structure 88 to the ground anchor 10. Specifically, the cleats 118, which are preferably conically shaped with cut-off ends, would extend to within the dirt receiving recesses 60 in the waffle portions 56 of ground anchor housing 14. Preferably, there are two rows of cleats on the outer ridge 108 of encasing portion 100, a single row of cleats around the inner ridge 110, and two rows of cleats on the inner square 120 of the encasing portion 100. The cleats 118 on the inner square 120 would extend downwardly into the recessed portion 50 (see especially FIG. 8). Each "row" of cleats would of course be a number of cleats extending in a square around the encasing portion 100. Together, all of the cleats 118 extend downwardly from the encasing portion 100 into dirt disposed within the dirt receiving recesses 60 and within the recessed portion 50, thereby tightly gripping the intermediate member 88 to the ground anchor 10 by way of dirt on top of housing 14.

With reference now to FIG. 10, the tool 122 of the present invention will be discussed in detail. FIG. 10 shows a perspective view illustrating the ground anchor 10 within the ground 11 and illustrating one use of the tool 122. The tool 122 includes a handle 124 and a blade 126. The blade 126 has a width of at least 1 inch and extends lengthwise along two parallel side edges 128 at least 5 inches to an end edge 130 which is opposite the handle and perpendicular to the side edges. The end edge 130 is beveled away from its front surface 132 as best shown in the side view of FIG. 12 with parts broken away. The blade 126 is attached to the handle 124 by a shaft 134, the blade 126 narrowing at portion 136 where the shaft 134 is attached.

The actual width of the blade 126 should be within ⅛ inch of the width of the receiving tube 20. For a preferred embodiment, the width of the blade 126 would be 1½ inches and the length of the straight parallel side edges 128 would be 8½ inches. As a preferred range, the width and indicated length should be within 10% of the preferred values.

FIG. 10 illustrates schematically how the tool 122 may be used to clean the receiving tube 20 of the ground anchor system 10. In particular, upon removal of the locator plug 12 (FIGS. 1 and 2), it may be necessary to remove some dirt from the receiving tube 20 in order to accommodate the supporting tube 94 (FIG. 4). The specially adapted tool 122 may be easily inserted into the receiving tube 20 and used to remove dirt. The width of blade 126 being just narrower than the receiving tube 20 (within ⅛ inch of the width of receiving tube) and the bevel on end edge 130 facilitate the easy removal of dirt from the receiving tube 20.

The tool 122 is additionally useful for removing dirt from the locator block receiving recess within channel 54 and defined between the cross channel ribs 126 (refer back to FIG. 4). In order to place intermediate member 88 properly above the ground support or anchor 10, the dirt must be sufficiently cleared between the cross channel ribs 116 such that the locator block 114 will properly seat therebetween. Accordingly, the distance between the cross channel ribs 116 is substantially identical to the width of the receiving tube 20 such that the blade 126 will readily fit between the cross channel ribs 116 and facilitate easy removal of dirt therefrom.

The tool 122 is further useful in separating the intermediate member 88 from the ground anchor 10. In particular, the cleats 118 (FIG. 7 only) tend to hold the intermediate structure 88 to the ground anchor 10. By insertion of the blade 126 of tool 122 into the channel 54 and movement of the handle 24 upwardly, the intermediate structure 88 can be easily separated from the ground anchor 10. Finally, the tool 122 is further useful for smoothing dirt over the ground anchor 10 after removal of the base 62 and intermediate structure 88. In particular, the ball field upon which the present device operates may be readily used for purposes other than baseball (or for baseball using bases at different locations), by removal of the bases such as base 62 and intermediate structure 88, after which the side edges 128 of blade 126 may be used to smooth dirt over the ground anchor 10 and locator plug 12 which would be inserted therein (as shown in FIG. 2).

The base 62 is operable to separate, partially or wholly, from the intermediate structure 88 upon the application of a sufficiently high lateral force. In particular, a sliding base runner will push the base 62 inwardly such that tapered portion 74 (see especially FIG. 4) will cooperate with beveled portion 106, thereby converting at least some of the lateral force to include an upwardly directed force tending to pull the fasteners 84 out of the recesses 80 (see FIG. 11). Generally, the fasteners 84 will hold and simply allow some flexing of the base 62 relative to the ground intermediate structure 88. However, potentially injury causing force will at least sever some of the fasteners 84 thereby lessoning the stress on the base runner's leg.

The particular desired severability level or characteristic will be dependent upon the class of player which will be using the base. A base which severs its connection upon a hard slide by an 80 pound ten year old will sever too easily for use by a professional. Accordingly, an important feature of the present invention is various techniques for varying the severability characteristics of the base dependent upon the class of players.

Referring back to FIGS. 5 and 6, one technique for varying the severability characteristics is to vary the number of fasteners. In particular, with all other things being equal, the base 62 of FIG. 5 will hold more tightly to the intermediate structure 88 than the base 62' of FIG. 6 because the base of FIG. 5 includes an extra fastening means recess 80 at each of the four corners. Although FIG. 7 shows five upwardly extending fasteners 84, one may alternately use nine upwardly extending fasteners. Then by simply varying the number of recesses 80 as opposed to depressions 78 (FIG. 5), any number between and including one to nine fasteners 84 may actually be operable at each of the four corners of the base 62. The conical depressions 78 do not lock or fasten to the fasteners 84 and, thus, the fasteners 84 which extend upwardly into the conical depressions 78 do not perform any gripping function except when used with a base having a recess corresponding to their location. Accordingly, the same encasing portion 100 and intermediate structure 88 may be used for any of the bases 62 regardless of the number of fasteners 84 which are to be engaged.

An additional method of varying the severability characteristic of the bases 62 is by control of the thickness of the exterior 64 (FIG. 4) of the base 62. The unibody exterior 64 of base 62 is made with a rotational molding process as discussed below and therefore has some variations in thickness at different parts of its exterior. However, an illustrative example of variation in thickness for a medium hardness polyvinyl chloride (PVC) exterior may be as follows:

| Type of Base | Approximate Thickness (Inches) |
|---|---|
| Youth | 3/32 |
| Teen | 1/8 |
| Adult | 3/16 |
| Pro | 7/32 rigidity |

As an alternative to varying the exterior thickness, (or in addition to), the density and/or rigidity of the resilient exterior may be varied to vary the severibility of the base.

As a further method of varying the rigidity and thus the severability characteristics of the base 62, the density of the resilient, cellular foam material 86 within the exterior 64 may be varied. In particular, the foam material 86 preferably has a free rise density of between two and six pounds per cubic foot. The foam material 86, is preferably a polyurethane flexible foam of high resilience polyester or polyether base. The actual density of the foamed material when placed within the exterior 64 will depend upon the volume within the exterior 64 and the amount of material placed therein. For example, the density of the foam 86 for a pro or professional level base 62 is approximately seven pounds per cubic foot, it being noted that this density is higher than the density in the indicated preferred free rise density range due to the restrictions of volume within the exterior 64. The actual figures for the density of the foam within the base would also depend upon the type of foam.

Thus, it will be seen that the severability characteristics of the base 62 can be varied to suit the class of player based upon three parameters; the number of engaged fasteners, the thickness of the cover or exterior of the base, and the density of the foam within the base. The factors are interrelated in that variations in one may be counteracted by variations in another of the factors.

The method of use of the present base to accommodate various classes of players comprises the steps, not necessarily in order, of:

(a) disposing the ground anchor 10 at least partially within the ground;

(b) removably securing the rigid support member (plate 90) to the ground anchor, with the resilient lower fastening means (fasteners 84) attached thereto;

(c) selecting a base 62 having a resilient exterior and a foam interior and a plurality of resilient upper fastening means (recesses 80 and lips 82) which mate with the lower fasteners 84, the base being selected dependent upon the thickness of its exterior and/or the density of its foam to realize a desired severability level corresponding to the class of players which are to use the base, the lower fastening means 84 accommodating bases of different severability levels corresponding to differences in their exterior thickness and/or foam densities; and (d) removably securing the selected base to the support member 90 by way of the fasteners.

As will be readily appreciated, the above steps are not necessarily in order in that one could select the base prior to disposing the ground anchor within the ground. However, step (a) will generally be performed first. The base could be selected and secured to the support member 90 prior to removably securing support member 90 to the ground support 10 by sliding the support tube 94 into the receiving tube 20 (FIG. 4). Alternately, the base 62 might be attached after the support member 90 is already disposed on the ground anchor 10.

The method of making the base 62 according to the present invention uses rotational molding to realize a unibody exterior which is highly advantageous. In particular, moldable material, such as liquid for forming polyvinyl chloride, is placed within a rotational mold. As known in the art, the rotational mold turns about 360 degrees (in all three axes) so as to force the liquid to the exterior of the mold. The mold is then rotated with the application of heat to form a resilient base exterior. After the base exterior has sufficiently hardened, foaming material, such as a flexible high resilience polyester or polyether base material is disposed within the exterior of the base. The foaming material may be supplied to the interior of the exterior by way of a hole corresponding to plug 76 in FIG. 5. Additionally, several small pin holes may be disposed in the exterior such that the foaming material going into the hole may push the air within the exterior out of the pin holes. The foaming material is foamed within the unibody exterior of the base 62. If desired, the plug 76 may than be placed in the base 62 (plug is shown in FIG. 5 only).

The shape of the rotational mold used to form the exterior 62 is, of course, identical to the shape of the exterior 64. With reference to FIGS. 5 and 6 it will be readily appreciated that the mold used to make base 62 may also be used to make the base 62' by simply adding a series of conical attachments to the interior of the mold corresponding to the additional depressions 78C' used in base 62'. However, bases 62 having different severability levels or characteristics may be made even without this slight change in the mold by simply putting a larger amount of material into the rotational mold to realize a thicker exterior 64 for greater rigidity (greater resistance to severance). Alternately, less material could be inserted into the rotational mold to make the exterior 64 thinner for lower rigidity and less resistance to severance. Further, variations in the amount of foamed material placed into the base 62 may change the severability characteristics of the base without any necessity of changing the mold used for producing the base.

Although the present description includes various details and particular structures, it is to be understood that these are for illustrative purposes only. Various modifications and adaptations will be apparent to those of ordinary skill in the art. Accordingly, the scope of the present invention should be determined by reference to the claims appended hereto.

What is claimed is:

1. An athletic contact device comprising: a base having a resilient exterior and a foam interior, said exterior including a lower mounting surface having a generally horizontal portion, said generally horizontal portion including a plurality of recesses, each recess having an engagement portion disposed at its entrance and defining a hole which is narrower than at least part of the recess; and a lower ground support comprising: a support plate having an encasing portion and a plurality of upwardly extending resilient fasteners fixed thereto and engageable to said engagement portions, a support tube fixed to extend downwardly from said support plate; a ground anchor housing having a receiving tube disposed therein; said receiving tube receiving said support tube to removably hold said support plate relative to said ground anchor housing;

wherein said recesses and engagement portions are operable to severably fasten said base to said lower ground support, said plurality of upwardly extending resilient fasteners fixed to said lower ground support extending into said recesses such that one or more of said engagement portions is severable from a corresponding fastener or fasteners upon a sufficiently high lateral force; and wherein said encasing portion has a plurality of locator means on its bottom and operable to mate with a plurality of complementary locator means on the top of said ground anchor housing, said locator means and complementary locator means together minimizing any pivoting of said rigid support member relative to said ground anchor housing.

2. The device of claim 1 wherein said ground anchor housing is wider at its bottom that at its top and includes side walls having at least one peripheral outwardly extending ground holding portion operable to resist removal of said ground anchor housing from the ground.

3. The device of claim 1 wherein said ground anchor housing is adapted for filling with concrete or other type of cement and includes concrete holding means for holding said ground anchor housing to concrete.

4. The device of claim 3 wherein said concrete holding means comprises a plurality of upwardly extending ribs on a top surface of said ground anchor housing, said ribs defining a plurality of dirt-receiving recesses.

5. An athletic contact device support structure comprising: a lower ground support having a rigid support member and a plurality of resilient fastening means, said fastening means operable to mate with fastening means on a base placed above said lower ground support; a resilient encasing portion covering a top and a bottom of said rigid support member at least at its periphery; and wherein said lower ground support further comprises: a support tube fixed to and extending downwardly from said support member; a ground anchor housing having a receiving tube disposed therein, said receiving tube receiving said support tube to removably hold said support member relative to said ground anchor housing; wherein said ground anchor housing is wider at its bottom than at its top and includes side walls having at least one peripheral outwardly extending ground holding portion operable to resist removal of said ground anchor housing from the ground, and wherein said ground anchor housing is adapted for filling with concrete or other type of cement; and wherein said ground anchor housing includes a concrete holding means for holding said ground anchor housing to concrete, said concrete holding means comprises a plurality of upwardly extending ribs on a top surface of said ground anchor housing, said ribs defining a plurality of dirt-receiving recesses.

6. The support structure of claim 5 wherein said encasing portion has a plurality of locator means on its bottom and operable to mate with a plurality of complimentary locator means on the top of said ground anchor housing, said locator means and complimentary locator means together minimizing any pivoting of said rigid support member relative to said ground anchor housing.

7. An athletic contact device support structure comprising: a lower ground support having a rigid support member and a plurality of resilient fastening means, said fastening means operable to mate with fastening means on a base placed above said lower ground support; a ground anchor housing having a receiving hole disposed therein, said receiving hole receiving a support tube extending downwardly from said support member to removably hold said support member relative to said ground anchor housing, said ground anchor housing operable to serve as a mold for concrete or other type of cement placed within said ground anchor housing prior to disposing said ground anchor housing within the ground; and wherein said ground anchor housing further comprises concrete holding means for holding said ground anchor housing to concrete, said concrete holding means comprises a plurality of upwardly extending ribs on a top surface of said ground anchor housing, said ribs defining a plurality of dirt-receiving recesses.

8. An athletic contact device comprising a base having a resilient exterior and a foam interior, said exterior including a lower mounting surface having a generally horizontal portion, said generally horizontal portion including a plurality of recesses, each recess having an engagement portion disposed at its entrance and defining a hole which is narrower than at least part of said recess; and a lower ground support comprising a rigid support member having a plurality of upwardly extending resilient fasteners engageable to said engagement portions, said resilient fasteners being integral with each other and integrally part of a resilient encasing portion, said resilient encasing portion covering the top and bottom of said rigid support member at least at its periphery; and wherein said recesses and engagement portions are operable to severally fasten said base to said lower ground support, said upwardly extending resilient fasteners extending into said recesses such that one or more of said engagement portions is severable from the corresponding fastener or fasteners upon a sufficiently high lateral force.

9. A baseball base system comprising: a base having a resilient exterior and a foam interior, said base having a lower mounting surface containing a substantially horizontal portion and beveled portions extending out and downwardly from said horizontal portion, said horizontal portion having fastening means; and an intermediate structure having an upper surface containing a substantially horizontal portion and beveled edges extending out and downwardly; said horizontal portion of said intermediate structure having substantially the same dimensions as said horizontal portion of said base, said horizontal portion of said intermediate structure further having fastening means disposed to severably engage said fastening means of said base, said intermediate structure further having a support tube extending downwardly from a lower surface; and wherein said support tube is operable to be removably inserted into a ground anchor housing disposed in the ground.

10. A baseball base system as defined in claim 9, further comprising a ground anchor housing disposed in the ground and having a receiving tube for receiving said support tube of said intermediate structure.

11. A baseball base system as defined in claim 9 wherein an upper surface of said base has a plurality of grooves disposed at each corner, said groove being oriented at a 45° angle to the edges of the upper surface.

12. A baseball base system as defined in claim 9, wherein said intermediate structure has a resilient encasing portion covering the top and bottom of said structure at least at its periphery.

* * * * *